US009618231B2

(12) United States Patent
Kowald et al.

(10) Patent No.: US 9,618,231 B2
(45) Date of Patent: Apr. 11, 2017

(54) FURNACE, A HIGH FIRE IGNITION METHOD FOR STARTING A FURNACE AND A FURNACE CONTROLLER CONFIGURED FOR THE SAME

(75) Inventors: Glenn W. Kowald, Carrollton, TX (US); Hans J. Paller, Double Oak, TX (US)

(73) Assignee: Lennox Industries Inc., Richardson, TX (US)

( * ) Notice: Subject to any disclaimer, the term of this patent is extended or adjusted under 35 U.S.C. 154(b) by 1358 days.

(21) Appl. No.: 13/208,918

(22) Filed: Aug. 12, 2011

(65) Prior Publication Data

US 2013/0040253 A1 Feb. 14, 2013

(51) Int. Cl.

| | |
|---|---|
| ***F23Q 9/08*** | (2006.01) |
| ***F24H 3/06*** | (2006.01) |
| ***F24H 9/20*** | (2006.01) |

(52) U.S. Cl.

CPC ..... *F24H 3/065* (2013.01); *F24H 9/2035* (2013.01)

(58) Field of Classification Search

USPC ..... 431/60; 236/10, 11; 126/116 A, 116 R, 126/99 R–99 D

See application file for complete search history.

(56) References Cited

U.S. PATENT DOCUMENTS

| | | | | |
|---|---|---|---|---|
| 4,251,025 | A * | 2/1981 | Bonne et al. | 236/14 |
| 4,815,524 | A * | 3/1989 | Dempsey et al. | 165/245 |
| 4,891,004 | A * | 1/1990 | Ballard et al. | 431/6 |
| 4,976,459 | A * | 12/1990 | Lynch | 236/11 |
| 5,027,789 | A * | 7/1991 | Lynch | 126/116 A |
| 5,197,664 | A * | 3/1993 | Lynch | 236/11 |
| 5,326,025 | A * | 7/1994 | Dempsey et al. | 236/11 |
| 5,340,028 | A * | 8/1994 | Thompson | 236/10 |
| 5,666,889 | A * | 9/1997 | Evens et al. | 110/190 |
| 5,732,691 | A * | 3/1998 | Maiello et al. | 126/116 A |
| 5,822,997 | A * | 10/1998 | Atterbury | 62/180 |
| 6,161,535 | A * | 12/2000 | Dempsey et al. | 126/110 R |
| 6,283,115 | B1 * | 9/2001 | Dempsey et al. | 126/110 R |
| 2002/0155405 | A1 * | 10/2002 | Casey et al. | 431/60 |
| 2005/0092317 | A1 * | 5/2005 | Hugghins et al. | 126/116 A |

* cited by examiner

*Primary Examiner* — Kenneth Rinehart
*Assistant Examiner* — Jason Lau
(74) *Attorney, Agent, or Firm* — Bell Nunnally & Martin LLP; Craig J. Cox

(57) ABSTRACT

The disclosure provides a controller for a multistage gas furnace, a multistage gas furnace and computer readable medium for performing a method to operate a furnace. In one embodiment, the controller includes: (1) an interface configured to receive a heating call and (2) a corrosion reducer configured to ignite the gas furnace at a high fire operation based on if an indoor circulating fan of the gas furnace is active.

20 Claims, 2 Drawing Sheets

FURNACE, A HIGH FIRE IGNITION METHOD FOR STARTING A FURNACE AND A FURNACE CONTROLLER CONFIGURED FOR THE SAME

TECHNICAL FIELD

This application is directed, in general, to furnaces and, more specifically, to igniting gas furnaces.

BACKGROUND

HVAC systems can be used to regulate the environment within an enclosure. Typically, an air blower or circulating fan is used to pull air from the enclosure into the HVAC system through ducts and push the air back into the enclosure through additional ducts after conditioning the air (e.g., heating or cooling the air). For example, a gas furnace, such as a residential gas furnace, is used in a heating system to heat the air.

Residential gas furnaces are tested during manufacturing to insure compliance with government and industry standards. For example, residential gas furnaces must pass a 100 day heat exchanger corrosion test per ANSI 21.47 requirements. This corrosion test is a cyclical test of four minutes of the burner on and eight minutes of the burner off. The corrosion test must be conducted with the circulating fan of the heating system continuously energized. Modulating or two-stage gas furnaces must pass the corrosion test at both low and high firing rates. At the low-fire rate, heat exchanger temperatures are significantly lower compared to the high firing rate. As such, it is more difficult to pass the corrosion test at the low-fire rate compared to the high-fire rate. Accordingly, some manufacturers have used expensive stainless steel materials, complicated internal flue baffling, increased the minimum firing rate, or reduced the overall furnace efficiency to pass the corrosion test at the low-fire rate.

SUMMARY

In one aspect, the disclosure provides a controller for a multistage gas furnace. In one embodiment, the controller includes: (1) an interface configured to receive a heating call and (2) a corrosion reducer configured to ignite the gas furnace at a high fire operation based on if an indoor circulating fan of the gas furnace is active.

In another aspect, a computer-usable medium having non-transitory computer readable instructions stored thereon for execution by a processor to perform a method for operating a gas furnace is disclosed. In one embodiment, the method includes: (1) receiving a heating call for the gas furnace, (2) determining if an indoor circulating fan of the gas furnace is active and (3) igniting the gas furnace at a high fire operation based of if the indoor circulating fan is active.

In yet another aspect, a multistage gas furnace having a heat exchanger is disclosed. In one embodiment the gas furnace includes: (1) an inducer configured to draw combustion air through the heat exchanger, (2) a high fire pressure switch configured to close when flow of the combustion air has been established, (3) an indoor circulating fan configured to move air across the heat exchanger and into conditioned space and (4) a controller configured to direct operation of the gas furnace. The controller having (4A) an interface configured to receive a heating call and (4B) a corrosion reducer configured to ignite the gas furnace at a high fire operation based on if the indoor circulating fan is active.

BRIEF DESCRIPTION

Reference is now made to the following descriptions taken in conjunction with the accompanying drawings, in which.

DETAILED DESCRIPTION

To improve corrosion performance, furnaces having at least two operating stages may be ignited at high-fire when receiving a heating call then transition to low-fire operation after a set period of time. A high fire ignition improves corrosion performance by increasing the temperature of a heat exchanger and therefore reducing the "wet time" of internal heat exchanger surfaces. The negative aspect of high-fire ignition is increased ignition noise and potential customer dissatisfaction. Thus, in conflict with corrosion performance, furnaces with multiple heat inputs are often ignited at the lowest firing rate since to provide the quietest operation.

The disclosure provides a high fire ignition routine to improve the corrosion performance of a heat exchanger and also avoid potential noise dissatisfaction of customers. The disclosure provides an ignition routine that selectively lights a furnace at high-fire when the indoor circulating fan of the furnace is active (i.e., is on or operating). In some embodiments, the furnace may be ignited at high-fire only when the indoor circulating fan is active. As such, the disclosed furnace realizes the benefit of high-fire ignition for corrosion performance, but avoids the increased sound level of high-fire ignition when a call for a circulating fan is not present. The disclosed ignition routine, therefore, advantageously uses the operation of an indoor circulating fan to mask the high-fire ignition of the furnace. For example, low speed Combustion Air Inducer (CAI) sound levels are typically 3 dB lower than high-speed and low-fire burner ignition can be 6 dB lower than high-fire ignition. Sound tests have shown an increase of less than 2 dBA when comparing low-fire ignitions versus high-fire ignitions during continuous fan mode due to the masking affect of the indoor circulating fan. As such, lighting on high-fire versus low-fire during continuous fan mode may be indiscernible to the customer. Lennox has aggressively pursued a sound claim as a marketing tool for upper tier furnace product and has therefore elected to always light modulating or two-stage product on low-fire to minimize CAI & burner sound during the startup sequence.

Figure 1:
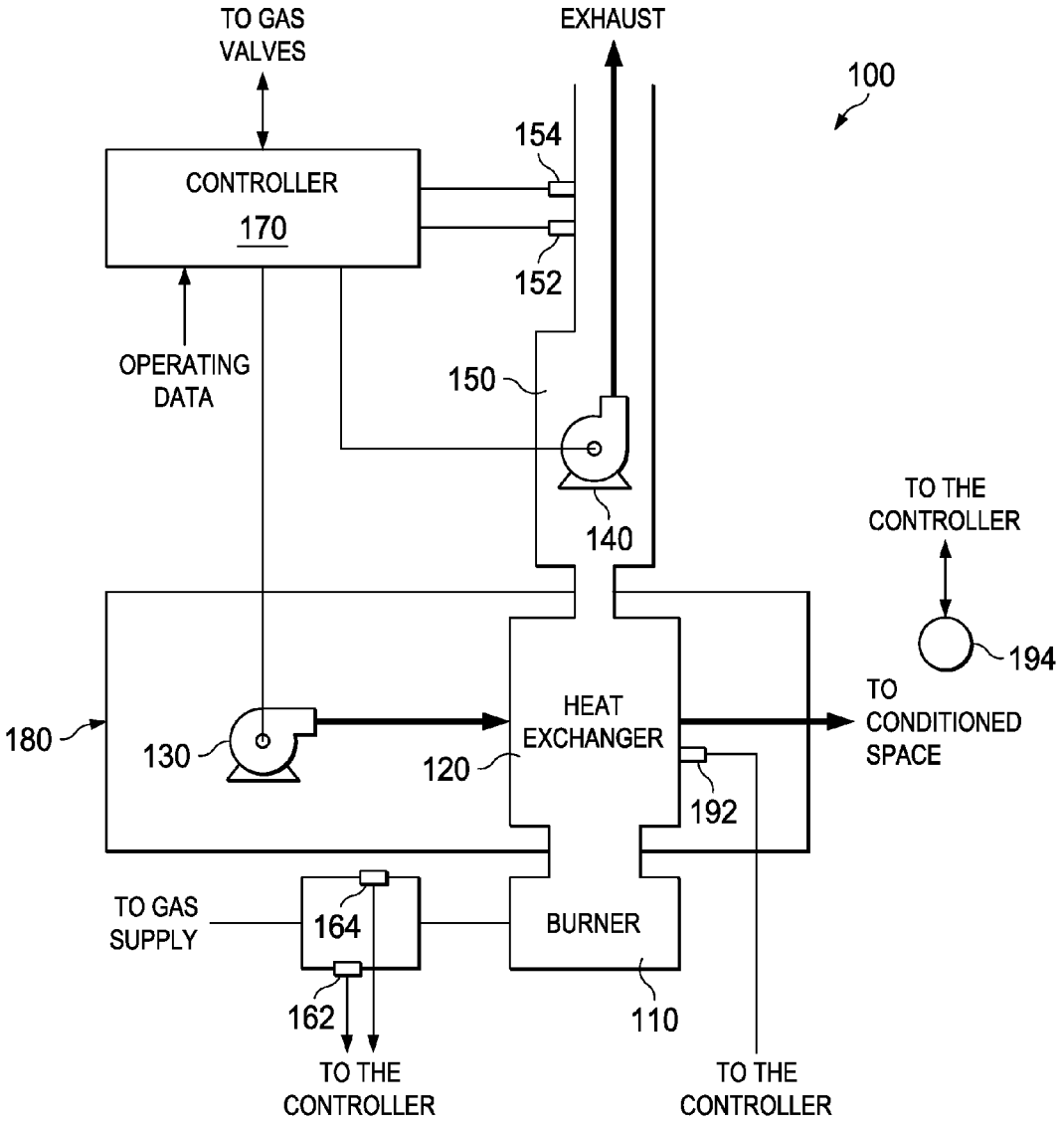
FIG. 1 is a diagram of an embodiment of a furnace constructed according to the principles of the disclosure.

FIG. 1 is a block diagram of an embodiment of a furnace 100 constructed according to the principles of the disclosure. The furnace 100 is a combustible fuel-air burning furnace, such as, a natural gas furnace or a propane furnace. The furnace 100 may be for a residence or for a commercial building (i.e., a residential or commercial unit).

The furnace 100 includes a burner assembly 110, a heat exchanger 120, an air circulation fan 130, a combustion air inducer 140, a low pressure switch 152, a high pressure switch 154, a low fire gas valve 162, a high fire gas valve 164 and a controller 170. Portions of the furnace may be contained within a cabinet 180. In some embodiments, the controller 170 may also be included in the cabinet 180. The furnace 100 also includes sensors that are configured to detect conditions associated with the furnace 100. A first sensor 192 and a second sensor 194 are illustrated as representative sensors. One skilled in the art will understand that the furnace 100 may include additional components and devices that are not presently illustrated or discussed but are typically included in a furnace. A thermostat (not shown) is also typically employed with a furnace and is used as a user interface.

The burner assembly 110 includes a plurality of burners that are configured for burning a combustible fuel-air mixture (e.g., gas-air mixture) and provide a combustion product to the heat exchanger 120. The heat exchanger 120 is configured to receive the combustion product from the burner assembly 110 and use the combustion product to heat air that is blown across the heat exchanger 120 by the indoor circulation fan 130. The indoor circulation fan 130 is configured to circulate air through the cabinet 180, whereby the circulated air is heated by heat exchanger 120 and supplied to conditioned space. The combustion air inducer 140 is configured to supply combustion air to the burner assembly 110 by an induced draft and is also used to exhaust products of combustion from the furnace 100. The indoor circulation fan 130 and the inducer 140 are each operable in at least two speed settings corresponding to the at least two modes of operation of the furnace 100.

The low pressure switch 152 and the high pressure switch 154 measure combustion air pressure on the discharge side of the combustion air inducer 140. One skilled in the art will understand that pressure may also be measured at other points in the heat exchanger 120 or as a differential pressure across a flow limiting orifice in the heat train. Low pressure switch 152 is configured to indicate when combustion air pressure is sufficient to support a low fire operation of the furnace 100. Similarly, high pressure switch 154 is configured to indicate when combustion air pressure is sufficient to support a high fire operation of the furnace 100. Accordingly, when the low pressure switch 152 is open, this indicates that there is insufficient combustion air to support even a low fire operation. When the high pressure switch 154 is open, this indicates that there is insufficient combustion air to support a high fire operation.

The furnace 100 is a multi-stage or variable input furnace operable in at least two modes of operation (e.g., low fire and high fire modes). Assuming two stages or two modes of operation, the furnace 100 also includes the low fire gas valve 162 and the high fire gas valve 164. In low fire operation, only the low fire gas valve 162 is opened to supply fuel to burner assembly 110. In high fire operation, both the low fire gas valve 162 and the high fire gas valve 164 are open to supply more fuel to burner assembly 110. One skilled in the art will understand that more gas valves and/or a different combination or arrangement of gas valves may be employed to supply fuel for multiple operation stages.

The controller 170 is configured to control the operation of the furnace 100 including operation of the low fire gas valve 162, the high fire gas valve 164, the combustion air inducer 140 and the indoor circulating fan 130, respectively. In some embodiments, the controller may include a designated burner control board and an air blower control board for controlling the gas valves 162, 164, the combustion air inducer 140 and the indoor circulating fan 130. In other embodiments, the burner control board and the air blower control board may be physically separated from each other or the controller 170 with the controller 170 communicating therewith to control operation of the gas valves 162, 164, the combustion air inducer 140, and the indoor air circulating fan 130. As such, the controller 170 may be an integrated controller or a distributed controller that directs operation of the furnace 100.

The controller 170 is configured to ignite the furnace 100 at a high fire operation (a high fire ignition) based on if the indoor circulating fan 130 is active. Thus, unlike conventional furnaces, the controller 170 is configured to ignite the furnace 100 according to the operational status of the indoor circulating fan 130 even if a heating call is for a low fire operation. The high fire ignition increases the temperature of the heat exchanger 120 and reduces "wet time" of internal surfaces of the heat exchanger 120. As such, the furnace 100 has an improved corrosion performance and reduced noise affect due to the sound masking of the indoor circulating fan 130.

The controller 170 may include an interface to receive the heating call and a processor, such as a microprocessor, to direct the operation of the furnace 100 as described above. Additionally, the controller 170 may include a memory section having a series of operating instructions stored therein that direct the operation of the controller 170 (e.g., the processor) when initiated thereby. The series of operating instructions may represent algorithms that are used to ignite the burner 110 at a high fire operation upon receipt of a heating call and a determination that the indoor circulating fan 130 is active. As illustrated in FIG. 1, the controller 170 is coupled to the various sensors and components of the furnace 100. In some embodiments, the connections therebetween are through a wired-connection. A conventional cable and contacts may be used to couple the controller 170 to the various components of the furnace 100. In some embodiments, a wireless connection may also be employed to provide at least some of the connections.

The first and second sensors 192, 194, may be conventional sensors that are employed to provide data for the controller 170 to use in directing the operation of the furnace 100. For example, the first and/or second sensors 192, 194, may be temperature sensors. Alternatively, one or both of the first and second sensors 192, 194, may for determining humidity or sound levels. The controller 170, therefore, may employ temperature data gathered by the sensors 192, 194, to determine a designated time period to operate the furnace 100 at high fire after ignition. In alternative embodiments, the sensor 192 or the sensor 194 may be other types of sensors that the controller 170 may employ to improve corrosion performance when the indoor circulating fan 130 is active.

Figure 2:
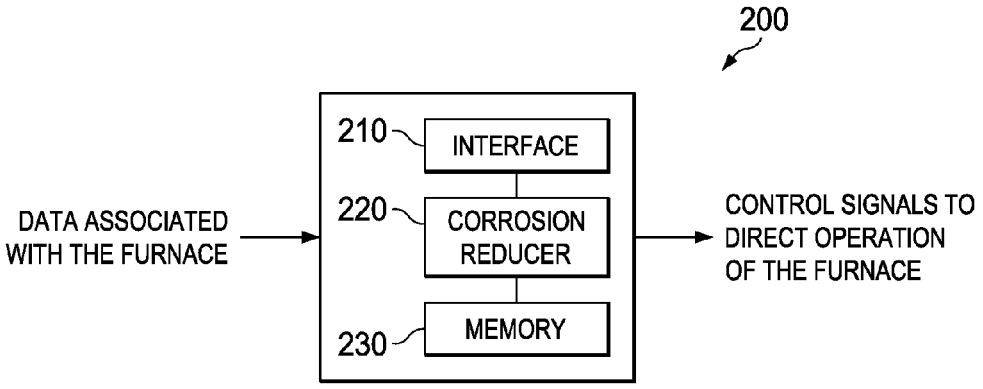
FIG. 2 is a block diagram of an embodiment of controller of a furnace constructed according to the principles of the disclosure.

FIG. 2 is a block diagram of an embodiment of a controller 200 of a furnace, such as the gas furnace 100 in FIG. 1, constructed according to the principles of the disclosure. As such, the various furnace components discussed with respect to the controller 200 may correspond to the like components of the furnace 100. The controller 200 includes an interface 210, a corrosion reducer 220 and a memory 230. The controller 170 of FIG. 1 may be implemented as the controller 200.

The interface 210 is configured to receive signals for and transmit signals from the controller 200. The interface 210 may be a conventional interface having input and output ports for communicating. The received signals may be operational or conditional data from various sensors employed by the furnace. Additionally, the received signals may be user input received from, for example, a thermostat. The transmitted signals may be commands or control signals used to direct the operation of the furnace. Each of the received and transmitted signals may comply with industry standards and may be communicated in a conventional way.

The corrosion reducer 220 may be embodied as a conventional processor. The corrosion reducer 220 is configured to ignite the furnace at a high fire operation based on if an indoor circulating fan of the furnace is active. In one embodiment, the corrosion reducer 220 is configured to automatically ignite the furnace at a high fire operation. Before igniting the burner of the furnace at high fire, the corrosion reducer 220 is configured to switch the inducer of the furnace to operate at a high speed and thereafter if the high fire pressure switch of the furnace is closed. When determining the high fire pressure switch is closed, the corrosion reducer 220 is configured to ignite the gas furnace at high fire operation according to the operating status of the indoor circulating fan.

The corrosion reducer 220 is also configured to monitor the operating status of the indoor air circulating fan. The operating status of the indoor air circulating fan may be determined based on signals received from the indoor circulating fan or a designated controller thereof. Additionally, the corrosion reducer 220 may determine the operating status based on operating modes of the furnace or components of the furnace. For example, the corrosion reducer 220 may be configured to determine the indoor circulating fan is active when the indoor circulating fan is in a continuous fan mode, a blower off delay, or heat pump defrost tempering mode.

The corrosion reducer 220 is further configured to adjust the fire rate of the furnace a designated time period after igniting the furnace at high fire operation. The fire rate is adjusted based on the type of heating call received, i.e., the type of heat call demand, and is maintained for the remainder of the heat cycle associated with the heating call. For example, if the heating call is a first stage heat demand, then the corrosion reducer 220 will direct the burner to transition to a low fire operation after the designated time period. Additionally, with the first stage heat demand, the inducer and the indoor circulating fan of the furnace are operated at low speed, the low pressure switch is used and the low fire gas valve is used. Thus, in some embodiments, the corrosion reducer 220 may be configured to operate the indoor circulating fan at a low speed even when igniting the gas furnace at high fire operation. If the received heating call is a second stage heating call, the high pressure switch must remain closed, the high fire gas valve is used, and the inducer and indoor circulating fan remain on high.

The designated period of time may be preset by the manufacturer or installer. In some embodiments, the preset time period is based on operating capacity or model of the furnace. Normal operating conditions, historical data, location of the installed furnace or a combination thereof may also affect the length of the preset time period. For example, the preset time period may be lengthened if the furnace is installed in high humidity area.

The corrosion reducer 220 may also be configured to determine the designated time period based on operating parameters of the furnace. The designated time period, therefore, may be a calculated time period based on the temperature of a heat exchanger, return air temperature, combustion air temperature, ambient temperature, etc. Various sensors, such as the first and second sensors 192 and 194 may be employed to provide temperatures or other factors, such as humidity, used to determine the designated time period.

The memory 230 may be a non-transitory computer readable memory. The memory 230 may include a series of operating instructions that direct the operation of the corrosion reducer 220 when initiated thereby. The series of operating instructions may represent algorithms that are used to manage operation of a furnace such as the furnace 100 of FIG. 1. As such, the series of operating instructions are used to direct the operation of a furnace as described herein, i.e., performed the described functions. In addition to the functions described herein, the controller 200 may also direct other operations of the furnace as well known in the art.

Figure 3:
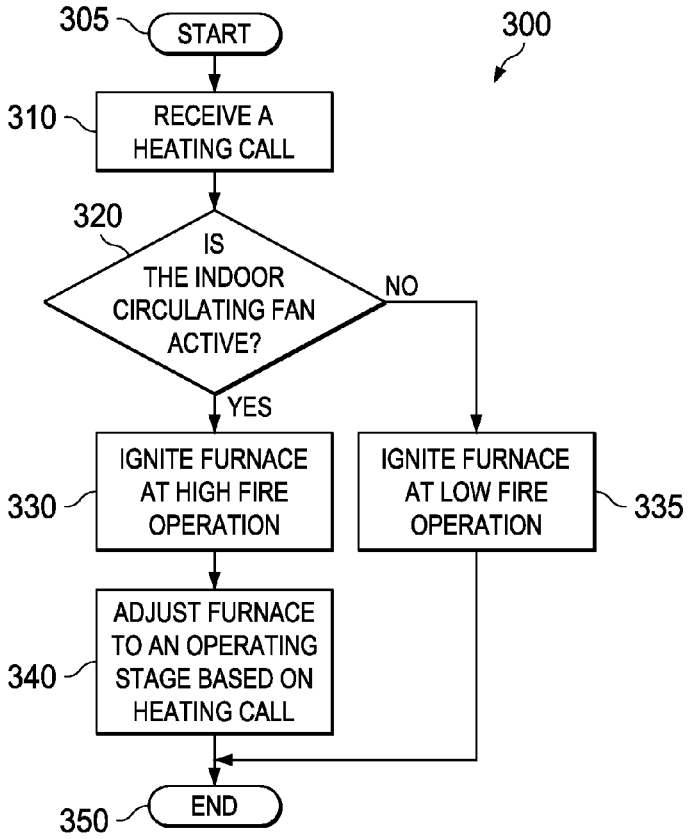
FIG. 3 is a flow diagram of an embodiment of a method of operating a furnace carried out according to the principles of the disclosure.

FIG. 3 is a flow diagram of an embodiment of a method 300 of operating a furnace carried out according to the principles of the disclosure. The controller 170 of FIG. 1 or the controller 200 of FIG. 2 may be used to perform the method 300. The method 300 includes igniting the gas furnace at a high fire operation based of if the indoor circulating fan is active. The method 300 begins in a step 305.

In a step 310, a heating call is received. The heating call may be received from a thermostat associated with the furnace.

A determination is then made in a decisional step 320 if an indoor circulating fan of the gas furnace is active. In some embodiments, determining if the indoor circulating fan is active is based on an operating mode of the furnace. A controller of the furnace may be used to indicate the operating mode. If the indoor circulating fan is active, the gas furnace is ignited at a high fire operation in a step 330.

In a step 340, the furnace is adjusted, a designated time period after igniting the gas furnace, to a particular operating stage based on the heating call. The furnace may transition to a low fire operation after the designated time period. In other embodiments, the furnace may stay at the high fire operation. The various components of the furnace, such as pressure switches, gas valves, etc., are adjusted according to the operating stage based on the heating call. The operating stage is maintained for the remainder of the heat cycle initiated by the heating call.

The designated time period may be preset by, for example, a manufacturer or an installer. In some embodiments, the designated time period may be automatically calculated based on operating parameters of the furnace and/or ambient conditions. Various sensors may be employed to determine the parameters and/or conditions. The method 300 then ends in a step 350.

Returning now to the decisional step 320, if the indoor circulating fan is not active (i.e., not on or not operating), then the gas furnace is ignited at low fire operation in a step 335. In some embodiments, sensor data may be used to determine if high fire ignition is required regardless of the status of the indoor circulating fan. The method 300 then proceeds to step 350 and ends.

The above-described corrosion reducer 220, at least a portion of the controller 170 and disclosed methods may be embodied in or performed by various digital data processors or computers, wherein the computers are programmed or store executable programs of sequences of software instructions to perform one or more of the steps of the methods. The software instructions of such programs may represent algorithms and be encoded in machine-executable form on conventional digital data storage media, e.g., magnetic or optical disks, random-access memory (RAM), magnetic hard disks, flash memories, and/or read-only memory (ROM), to enable various types of digital data processors or computers to perform one, multiple or all of the steps of one or more of the above-described methods. Accordingly, computer storage products with a computer-readable medium, such as a non-transitory computer-readable medium, that have program code thereon for performing various computer-implemented operations that embody the tools or carry out the steps of the methods set forth herein may be employed. A non-transitory media includes all computer-readable or computer-usable media except for a transitory, propagating signal. The media and program code may be specially designed and constructed for the purposes of the disclosure, or they may be of the kind well known and available to those having skill in the computer software arts. An apparatus may be designed to include the necessary circuitry or series of operating instructions to perform each step or function of the disclosed methods, corrosion reducer or controller.

Those skilled in the art to which this application relates will appreciate that other and further additions, deletions, substitutions and modifications may be made to the described embodiments.

What is claimed is:

1. A controller for a multistage gas furnace, comprising:
an interface configured to receive a heating call; and
a corrosion reducer configured to ignite said gas furnace at a high fire operation based on if an indoor circulating fan of said gas furnace is active.

2. The controller as recited in claim 1 wherein said corrosion reducer is further configured to determine if said indoor circulating fan is active.

3. The controller as recited in claim 2 wherein said corrosion reducer is configured to determine said indoor circulating fan is active based on an operating mode of said furnace.

4. The controller as recited in claim 1 wherein said corrosion reducer is further configured to transition said gas furnace to a low fire operation a designated time period after igniting said gas furnace.

5. The controller as recited in claim 4 wherein said designated period of time is preset.

6. The controller as recited in claim 4 wherein said corrosion reducer is configured to determine said designated period of time based on operating parameters of said gas furnace.

7. The controller as recited in claim 1 wherein said corrosion reducer is configured to operate said indoor circulating fan at a low speed when igniting said gas furnace at said high fire operation.

8. A computer-usable medium having non-transitory computer readable instructions stored thereon for execution by a processor to perform a method for operating a gas furnace, comprising:
receiving a heating call for said gas furnace;
determining if an indoor circulating fan of said gas furnace is active; and
igniting said gas furnace at a high fire operation based on if said indoor circulating fan is active.

9. The computer-usable medium as recited in claim 8 wherein said determining is based on an operating mode of said furnace.

10. The computer-usable medium as recited in claim 8 wherein said method further comprises transitioning to a low fire operation a designated time period after igniting said gas furnace.

11. The computer-usable medium as recited in claim 10 wherein said designated period of time is preset.

12. The computer-usable medium as recited in claim 10 wherein said method further comprises determining said designated period of time based on operating parameters of said gas furnace.

13. The computer-usable medium as recited in claim 8 wherein said method further comprises operating said indoor circulating fan at a low speed when igniting said gas furnace at said high fire operation.

14. The computer-usable medium as recited in claim 8 wherein said method further comprises operating said indoor circulating fan and said gas furnace based on said heating call a designated period of time after igniting said gas furnace at said high fire operation.

15. A multistage gas furnace having a heat exchanger, comprising:
an inducer configured to draw combustion air through said heat exchanger;
a high fire pressure switch configured to close when flow of said combustion air has been established;
an indoor circulating fan configured to move air across said heat exchanger and into conditioned space; and
a controller configured to direct operation of said gas furnace, said controller including:
an interface configured to receive a heating call; and
a corrosion reducer configured to ignite said gas furnace at a high fire operation based on if said indoor circulating fan is active.

16. The gas furnace as recited in claim 15 wherein said corrosion reducer is further configured to determine if said indoor circulating fan is active.

17. The gas furnace as recited in claim 16 wherein said corrosion reducer is configured to determine if said indoor circulating fan is active based on an operating mode of said furnace.

18. The gas furnace as recited in claim 15 wherein said corrosion reducer is further configured to transition to a low fire operation a designated time period after igniting said gas furnace.

19. The gas furnace as recited in claim 18 wherein said corrosion reducer is configured to determine said designated period of time based on operating parameters of said gas furnace.

20. The gas furnace as recited in claim 19 wherein said corrosion reducer is configured to operate said indoor circulating fan at a low speed when igniting said gas furnace at said high fire operation.

* * * * *